US006457284B1

(12) United States Patent
Isoda

(10) Patent No.: US 6,457,284 B1
(45) Date of Patent: Oct. 1, 2002

(54) STRUCTURE FOR INSTALLING A VISCOUS VIBRATION DAMPING WALL AND METHOD OF INSTALLING THE SAME

(75) Inventor: Kazuhiko Isoda, Tokyo (JP)

(73) Assignee: Shimizu Corporation, Tokyo (JP)

( * ) Notice: Subject to any disclaimer, the term of this patent is extended or adjusted under 35 U.S.C. 154(b) by 0 days.

(21) Appl. No.: 09/763,145

(22) PCT Filed: Sep. 1, 1999

(86) PCT No.: PCT/JP99/04739

§ 371 (c)(1),
(2), (4) Date: Feb. 20, 2001

(87) PCT Pub. No.: WO00/14362

PCT Pub. Date: Mar. 16, 2000

(30) Foreign Application Priority Data

Sep. 2, 1998 (JP) ..... 10-247970

(51) Int. Cl.[7] ..... E04H 9/02

(52) U.S. Cl. ..... 52/167.1; 52/167.8; 52/745.1; 52/745.09

(58) Field of Search ..... 52/167.1, 167.8, 52/741.1, 745.1, 745.2, 745.09

(56) References Cited

U.S. PATENT DOCUMENTS 5,732,802 A * 3/1998 Tsukagoshi ..... 52/167.1 X
5,740,652 A * 4/1998 Inoue et al. ..... 52/745.1
5,875,589 A * 3/1999 Lai et al. ..... 52/1
6,037,403 A * 3/2000 Katase et al. ..... 524/579
6,141,919 A * 11/2000 Robinson ..... 52/167.7

FOREIGN PATENT DOCUMENTS

| | | | | |
|---|---|---|---|---|
| JP | 59-52069 | | 3/1984 | |
| JP | 8-338153 | | 12/1996 | |
| JP | 9-310531 | | 12/1997 | |
| JP | 10-46865 | | 2/1998 | |
| JP | 10-220063 | | 8/1998 | |
| JP | 02000027485 | A * | 1/2000 | ..... E04H/9/02 |
| JP | 02000027486 | A * | 1/2000 | ..... E04H/9/02 |
| JP | WO00/12843 | * | 3/2000 | ..... E04H/9/02 |
| JP | WO 01/16445 | A1 * | 3/2001 | ..... E04B/2/56 |
| JP | 2001123698 | A * | 5/2001 | ..... E04H/9/02 |
| JP | 02001227193 | A * | 8/2001 | ..... E04H/9/02 |

* cited by examiner

*Primary Examiner*—Carl D. Friedman
*Assistant Examiner*—Brian E. Glessner
(74) *Attorney, Agent, or Firm*—Nixon & Vanderhye

(57) ABSTRACT

In a structure for installing a viscous vibration-damping wall 1, the viscous vibration-damping wall 1 is constructed such that a housing 20 with its upper end open is formed by uprightly setting a pair of steel-made side plates on a base plate 8 and by disposing a pair of flange plates 11 on both sides of the pair of side plates, an intermediate plate 14 is inserted in said housing, and a viscous material is placed in its gap portion. The viscous vibration-damping wall 1 is connected to base-plate connecting hole portions 9 and a pair of flange-connecting gusset plates 7 of a rising metal plate 6 fixed on a lower-floor girder 3, and the intermediate plate 14 is directly connected to a gusset plate 13 fixed to an upper-floor girder 4.

8 Claims, 8 Drawing Sheets

"PRIOR ART"

"PRIOR ART"

STRUCTURE FOR INSTALLING A VISCOUS VIBRATION DAMPING WALL AND METHOD OF INSTALLING THE SAME

TECHNICAL FIELD

The present invention relates to a structure for installing a viscous vibration-damping wall and a method of installing the same, and more particularly to a structure for installing a viscous vibration-damping wall whose connecting structure is simple and which, while possessing a sufficient withstanding force, can be manufactured at low cost and installed speedily by making improvements on the structure for installing the viscous vibration-damping wall on a main frame structure, as well as a method of installing the same.

BACKGROUND ART

Measures for enhancing the damping performance of structures have been adopted since ancient times to enhance the safety of earthquake resistance of building structures and improve the dwelling ability of structures against the wind and other dynamic external forces. As specific solutions therefor, viscous vibration-damping walls have been put to practical use, and the number of the viscous vibration-damping walls actually adopted has been on an increasing trend in recent years.

The viscous vibration-damping wall is constructed such that an upper-end open housing, which is formed by a pair of steel-made side plates mounted on a base plate and a pair of flange plates disposed on both sides of the pair of side plates, is integrated with a lower-floor girder, an intermediate plate integrated with an upper-floor girder is inserted in it, and a viscous material or a viscoelastic material is placed in the gap therebetween with a predetermined thickness.

To build the vibration-damping wall, connection to a main frame structure is required, but under the present circumstances connection metal plates from the main frame structure for connection to the viscous vibration-damping wall include a large number rib plates and make the joints complex, constituting a factor for higher cost.

Referring to FIG. 8, a description will be given of the connection between a conventional viscous vibration-damping wall and the main frame structure. A base plate 32 of a housing 31 making up a vibration-damping wall 30 is bolted to a flange surface of a rising metal plate 34 disposed on a lower-floor girder 33, while an intermediate plate 35 of the vibration-damping wall has a top plate 36 welded to its tip portion and is bolted to a flange surface of a mounting plate 38 disposed on an upper-floor girder 37.

In this state, when the vibration-damping wall 30 bears a horizontal force due to an external force, bending moment due to the borne shearing force occurs between the top plate 36 and the base plate 32 at the upper and lower ends.

The stress applied to the joints acts as the horizontal shearing force with respect to the bolts at the plane of connection, and at the same time a vertical axial force which is distributed widely at the edge portions of the vibration-damping wall 30 occurs in the bolts at the plane of connection due to the bending moment. As a result, large bending stresses occur in the top plate 36 and the base plate 32 having bolt holes arranged horizontally, so that it is necessary to adopt countermeasures for the respective plates.

Consequently, as shown in the drawing, a multiplicity of vertical rib plates 39 and 40 are fixed to the base plate 32 and the top plate 36 as well as the rising metal plate 34 and the mounting plate 38 corresponding thereto, and large-scale reinforcement is provided particularly at the edge portions of the vibration-damping wall. This results in an enormously large increase in cost, and constitutes a hindrance to the connection to a member perpendicular to a girder, and to through holes of sleeves of the facility.

Since the damping performance which can be added to a structure is proportional to the quantity of vibration-damping walls that are installed, it is desirable to adopt a large number of vibration-damping walls. However, since the cost required in the installation is also proportional to the quantity used, it is an important problem to reduce the cost of the building construction of the vibration-damping walls and to prevent adverse effects from being exerted on other execution of works.

To overcome this problem, as shown in FIG. 9, a method of building construction has been proposed in which all the upper and lower flange portions are removed. (Refer to JP-A-10-46865)

In this proposal, as shown in the drawing, a bolting steel plate 52 is provided which has the same thickness as an inner wall steel plate 51 of a vibration-damping wall 50 to be fixed to the underside of an upper-floor girder or a reinforced portion thereof, and the inner wall steel plate 51 of the vibration-damping wall is disposed immediately therebelow. A pair of bolting reinforcing plates 53 are disposed on both sides of the inner wall steel plate 51, and the three steel plates are tightened by high-strength bolts 54 so as to be integrated.

In addition, on a lower floor side, a bolting lower steel plate 56 is welded in advance to lower sides of a pair of outer wall steel plates 55, and a steel plate 57 of the same thickness as the bolting lower steel plate 56 is provided on a lower-floor girder, and is integrated therewith in the same way as the upper side.

An assertion is made that it is possible to substantially reduce the cost required for the overall building construction of the vibration-damping wall, since the mechanism for transmitting the stress can be rationalized and the fabrication of the vibration-damping wall itself and the fixing portions can be both simplified by virtue of the construction in which flanged connections in the upper and lower portions are eliminated, as described above.

However, with the vibration-damping wall according to this proposal, the vibration-damping wall itself is specially provided with the bolting lower steel plate, the inner wall steel plate is provided with an upper reinforced portion, and the friction-type high-strength bolted connection for jointing adopts a structure in which a multiplicity of bolts are arranged on end portion sides of the vibration-damping wall. Such a construction is a natural consequence of the fact that the bolting lower steel plate and the inner wall steel plate need to simultaneously withstand both the shearing force and the tensile force with respect to the bending moment occurring in the vibration-damping wall. A substantial thickness must be inevitably secured for the bolting lower steel plate, so that the cost of the vibration-damping wall itself is not much different from other conventional vibration-damping walls.

In addition, concerning the handling of the vibration-damping wall, since the structure adopted is such that the vibration-damping wall cannot be self-supported, special attention is required for safety and workability under the circumstances of transportation, storage, and on-site setting.

The present invention provides a structure for installing a viscous vibration-damping wall which is simple while possessing a sufficient withstanding force, and which can be manufactured at low cost and installed speedily by making improvements on the structure for connection at the time of installing the viscous vibration-damping wall on a main frame structure, as well as a method of installing the same.

DISCLOSURE OF INVENTION

The structure for installing a viscous vibration-damping wall in accordance with the present invention is basically a structure for installing a viscous vibration-damping wall in which a housing with its upper end open is formed by uprightly setting a pair of steel-made side plates on a base plate and by disposing a pair of flange plates on both sides of the pair of side plates, an intermediate plate is inserted in the housing, and a viscous material or a viscoelastic material is placed in its gap portion, characterized in that a rising metal plate is fixed on a flange of a lower-floor girder, that the base plate and each of the flange plates are respectively connected to base-plate connecting hole portions provided in an upper surface of the rising metal plate and a flange-connecting gusset plate disposed on each side surface of the rising metal plate, and that the intermediate plate is directly connected to a gusset plate attached to a flange of an upper-floor girder. Specifically, the structure for installing a viscous vibration-damping wall is characterized in that the connection between the flange plate and the flange-connecting gusset plate is one-plane friction-type high-strength bolted connection by means of a flange-connecting gusset plate, and that the direct connection between the intermediate plate and the gusset plate is one-plane friction-type high-strength bolted connection or two-plane friction-type high-strength bolted connection using a pair of splicing plates or a pair of splicing plates each of which is divided.

By virtue of the above-described structure, the top plate, the brackets, and the reinforcing rib plates at various portions which have been used in the building construction of the vibration-damping wall are made substantially unnecessary, the reduction of the thickness of the base plate and the number of bolts is attained, and the vibration-damping wall can be self-supported, so that the safety of construction work and workability are improved.

In addition, the method of installing a viscous vibration-damping wall in accordance with the present invention comprises the steps of: setting the lower-floor girder with the rising metal plate fixed, the lower-floor girder comprising the base-plate connecting hole portions and the flange-connecting gusset plates; setting at a predetermined position the upper-floor girder with which the viscous vibration-damping wall is integrated by connecting the intermediate plate to the disposed gusset plate and by connecting the housing to the upper-floor girder by means of a pair of temporary suspending pieces; subjecting the base plate and the flange plates to friction-type high-strength bolted connection to the base-plate connecting hole portions and the flange-connecting gusset plates, respectively, of the lower-floor girder; and removing the temporary suspending pieces. Accordingly, handling is simple, shear deformation of the viscous material is prevented while performing speedy installation, and the movability of the vibration-damping wall is prevented.

The structure for installing a viscous vibration-damping wall in accordance with the present invention is characterized in that, in order to install a viscous vibration-damping wall constructed such that a housing with its upper end open is formed by uprightly setting a pair of steel-made side plates on a base plate and by disposing a pair of flange plates on both sides of the pair of side plates, an intermediate plate is inserted in the housing, and a viscous material or viscoelastic material is placed in its gap portion, the base plate and the flange plates are respectively connected to base-plate connecting hole portions provided in an upper surface of a rising metal plate fixed on a flange of a lower-floor girder and to a pair of flange-connecting gusset plates disposed on side surfaces of the rising metal plate, and the intermediate plate is directly connected to a gusset plate fixed to a flange of an upper-floor girder. Accordingly, advantages are offered in that the top plate, the brackets, and the reinforcing rib plates at various portions which have been used in the building construction of the vibration-damping wall are made lightweight, and the reduction of the thickness of the base plate and the number of bolts is attained, thereby making it possible to reduce the cost. Further, since the vibration-damping wall can be self-supported, an advantage can be demonstrated in that the safety of construction work and workability can be improved.

In addition, the method of installing a viscous vibration-damping wall in accordance with the present invention is characterized by comprising the steps of: setting the lower-floor girder with the rising metal plate fixed, the lower-floor girder comprising the base-plate connecting hole portions and the flange-connecting gusset plates; setting at a predetermined position the upper-floor girder to the gusset plate of which the intermediate plate is connected and with which the housing is integrated by means of a temporary suspending pieces; subjecting the base plate and the flange plates to friction-type high-strength bolted connection to the base-plate connecting hole portions and the flange-connecting gusset plates, respectively, of the lower-floor girder; and removing the temporary suspending pieces. Accordingly, advantages are offered in that handling can be made simple, shear deformation of the viscous material can be prevented, and the movability of the vibration-damping wall can be prevented.

Hereafter, a description will be given of the embodiments of the present invention with reference to the drawings.

EMBODIMENTS

Figure 1:
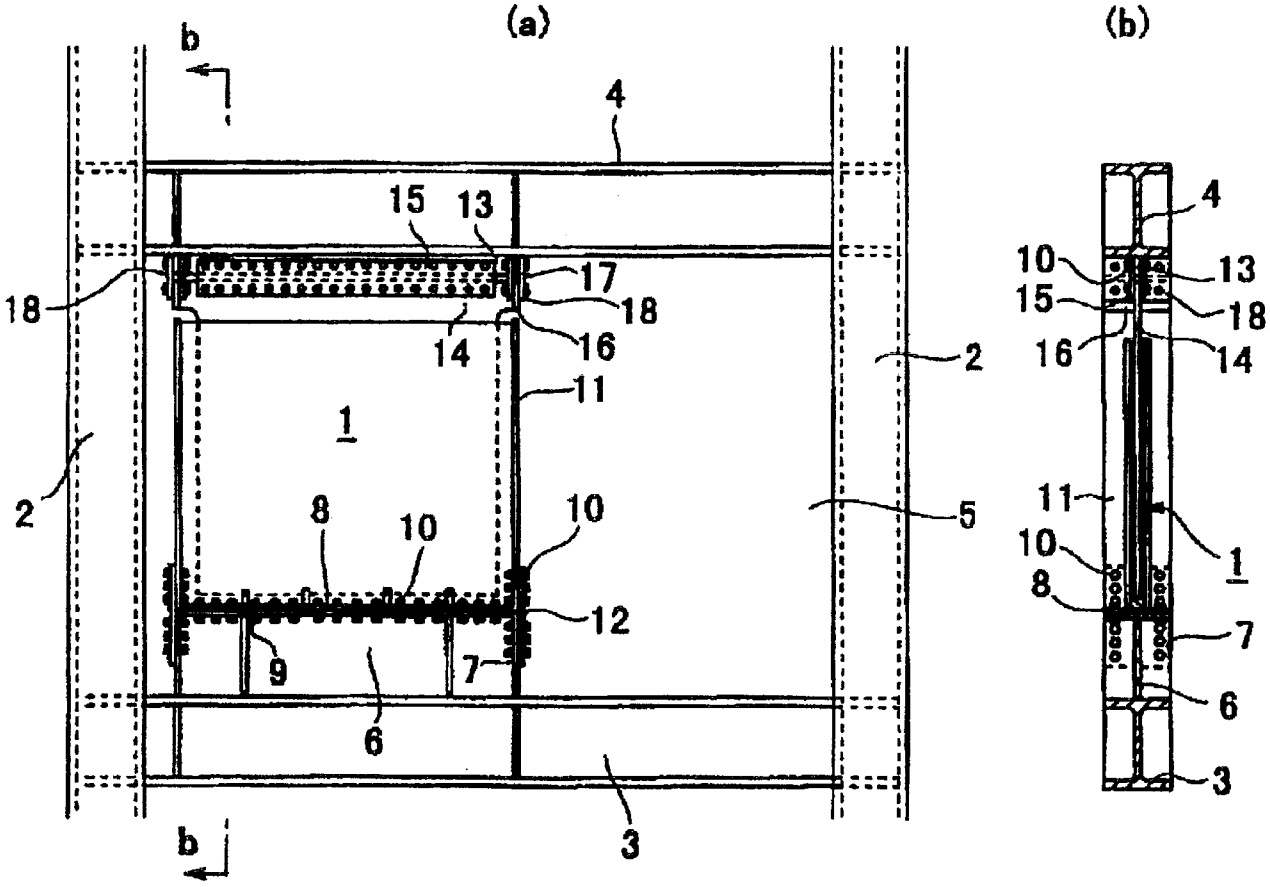
FIG. 1 is a diagram of a state in which a viscous vibration-damping wall in accordance with the invention is installed on a main frame structure.

FIG. 1 is an elevational view and a cross-sectional view, taken in the direction of arrows, of a state in which a viscous vibration-damping wall in accordance with the invention is installed on a main frame structure.

A viscous vibration-damping wall 1 is disposed in a plane of structure 5 which is formed by a pair of pillars 2, a lower-floor girder 3, and an upper-floor girder 4, and is joined to a rising metal plate 6 of the lower-floor girder 3 and the upper-floor girder 4, respectively.

The rising metal plate 6 welded to a flange surface of the lower-floor girder 3 has base-plate connecting hole portions 9 provided in its upper surface and a pair of flange-connecting gusset plates 7 attached to its side surfaces by welding, and is thus integrated with the lower-floor girder 3. The rising metal plate 6 is adopted to set the working plane for the friction-type high-strength bolted connection of the viscous vibration-damping wall 1 on a floor slab without damaging the base metal of the lower-floor girder 3 by bolt holes and the like. The adoption of the rising metal plate 6 has an advantage in that when the need has arisen to replace the viscous vibration-damping wall 1, the replacement work is facilitated.

The viscous vibration-damping wall 1 is placed on the rising metal plate 6, and a base plate 8 of the viscous vibration-damping wall and the base-plate connecting hole portions 9 of the rising metal plate 6 are frictionally connected in one plane by high-strength bolts 10. Similarly, a flange plate 11 on each side of the viscous vibration-damping wall and the flange-connecting gusset plate 7 are frictionally connected in one plane by the high-strength bolts 10 by means of a flange connecting plate 12, thereby integrally joining the viscous vibration-damping wall 1 and the lower-floor girder 3.

The flange-connecting gusset plates 7 process as the shearing force of the high-strength bolts the bending moment occurring due to the shearing force which is borne by the viscous vibration-damping wall 1 during an earthquake, by making use of the fact that the bending moment is converted to vertical force at the portions of the flange plates 11 disposed on both sides of the viscous vibration-damping wall, thereby suppressing and damping the lifting force of the base plate and the vertical force occurring substantially in edge portions of the viscous vibration-damping wall.

Accordingly, the base plate 8 of the viscous vibration-damping wall 1 and the base-plate connecting hole portions 9 of the rising metal plate 6 are of the base plate type in the same way as the conventional art. However, since a tensile force does not occur in the connection bolts unlike the conventional viscous vibration-damping wall, reinforcing rib plates are formed with a small thickness and a compact size and in a small number, and a simple state of connection is thus formed, as illustrated in the drawings.

A gusset plate 13 is attached by welding to a lower flange surface of the upper-floor girder 4 in alignment with the web of the girder.

Both an intermediate plate 14 of the viscous vibration-damping wall 1 and the gusset plate 13 are clamped by two splicing plates 15, and are directly connected to each other by being frictionally connected in two planes by the high-strength bolts 10. Further, the intermediate plate 14 at its end portions on both sides is provided with a pair of flange plates 16, each of which and each of a pair of flange plates 17 of the gusset plate 13 suspended from the upper-floor girder 4 are clamped by two splicing plates 18, and are directly connected to each other by being frictionally connected in two planes by the high-strength bolts 10. The viscous vibration-damping wall 1 and the upper-floor girder 4 are thus integrally joined by these members.

In the direct connection between the intermediate plate 14 and the gusset plate 13, since a top plate provided on a conventional intermediate plate and a bracket suspended from the upper-floor girder are eliminated, the height of the viscous vibration-damping wall can be made large, and the shear area of the viscous vibration-damping material is increased, thereby making it possible to improve the damping performance.

A description has been given of the viscous vibration-damping wall 1 on the basis of an example in which one intermediate plate 14 is used. However, since it is known that, among the viscous vibration-damping walls, there are those in which a plurality of intermediate plates are used to strengthen the damping force with respect to the seismic force, in the structure for installing a viscous vibration-damping wall and the method of installing the same in accordance with the invention as well, the viscous vibration-damping wall is not limited to a specific viscous vibration-damping wall, including the number of intermediate plates.

Figure 2:
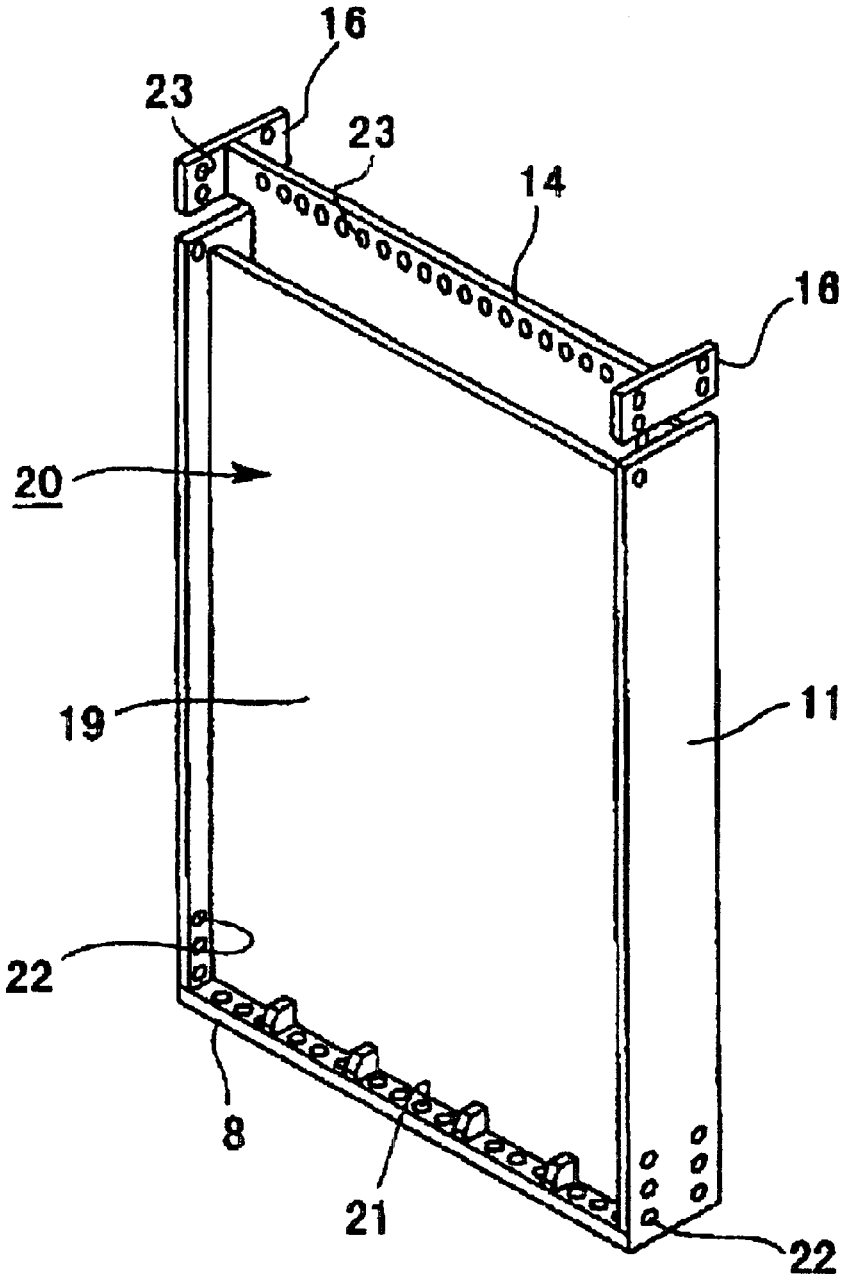
FIG. 2 is a perspective view of the viscous vibration-damping wall in accordance with the invention.

FIG. 2 is a perspective view of the viscous vibration-damping wall.

In the viscous vibration-damping wall 1, as shown in the drawing, a housing 20 with its upper end open is formed by uprightly setting a pair of steel-made side plates 19 on the base plate 8 and by disposing the pair of flange plates 11 on both sides of the pair of side plates 19, and the intermediate plate 14 is inserted in the housing 20. A viscous material or a viscoelastic material is placed in the gap between the housing 20 and each side of the intermediate plate 14, and the arrangement provided is such that a horizontal force applied from the outside is dampened between the base plate 8 and the intermediate plate 14.

The base plate method enhances the safety of construction work and facilitates site work since the viscous vibration-damping walls can be self-supported stably during their transportation, storage, and on-site setting and since they are lightweight.

Although the base plate 8 in its outward appearance appears to be the same as the conventional viscous vibration-damping wall, since it is unnecessary to withstand the vertical force, as described above, the reinforcing rib plates are formed in a compact and simple shape with a small thickness.

The base plate 8 and the flange plates 11 are respectively provided with bolt holes 21 and 22 for the high-strength bolts for effecting one-plane friction-type connection to the base-plate connecting hole portions provided in the rising metal plate and the flange-connecting gusset plate, respectively. Provided in a tip portion of the intermediate plate 14 are bolt holes 23 for the high-strength bolts for effecting two-plane friction-type connection to the splicing plates 15 at the time of directly connecting the intermediate plate 14 to the gusset plate 13.

Figure 3:
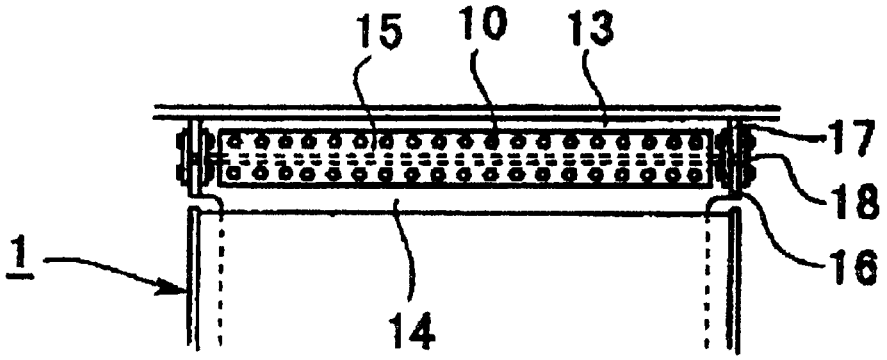
FIG. 3 is a diagram of a state in which the viscous vibration-damping wall is fixed to an upper-floor girder.

FIG. 3 shows an embodiment of connecting the intermediate plate and the gusset plate.

In this embodiment, the gusset plate 13 and the intermediate plate 14 are directly connected. Namely, the gusset plate 13 and the intermediate plate 14 are clamped by the two splicing plates 15, and are connected by being subjected to two-plane friction-type connection by the high-strength bolts 10 arranged in parallel in the splicing plates 15. The viscous vibration-damping wall 1 and the upper-floor girder 4 are thereby integrally connected.

In the direct connection of the gusset plate 13 and the intermediate plate 14, the splicing plates 15 are not necessarily required, and if the welding position of the gusset plate is offset in advance from the center of the web of the upper-floor girder such that the center of the web of the upper-floor girder and the center of the intermediate plate are aligned with each other, the direct connection of the gusset plate 13 and the intermediate plate 14 can be also effected by directly connecting them by one-plane friction-type connection using the high-strength bolts.

The adoption of this one-plane friction-type connection contributes to the reduction of the cost since the splicing plates are disused.

Figure 4:
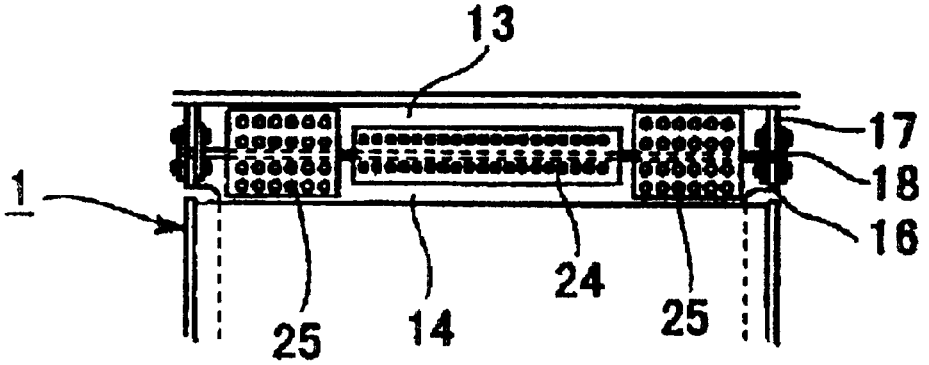
FIG. 4 is a diagram of another state in which the viscous vibration-damping wall is fixed to the upper-floor girder.

FIG. 4 shows another embodiment of connecting the intermediate plate and the gusset plate.

In this embodiment, although there is no specific change in the intermediate plate, a difference lies in that each splicing plate is divided into a central portion 24 and a pair of side portions 25. The bolt holes are arranged in a single row on each of upper and lower sides of the central portion 24 of the splicing plate, while two rows of bolt holes each on upper and lower sides are arranged on the side splicing plates 25 so as to cope with the allotted shear stresses.

The division of the splicing plate is not only rational in the allotment of the stress, but has an advantage of being able to flexibly cope with the unevenness between the gusset plate and the intermediate plate caused by the erection accuracy at the site. Further, since the weight per location can be reduced, this arrangement exhibits the advantage of allowing the operation to be performed sufficiently by the human strength of operators without using special heavy machinery or equipment.

Figure 5:
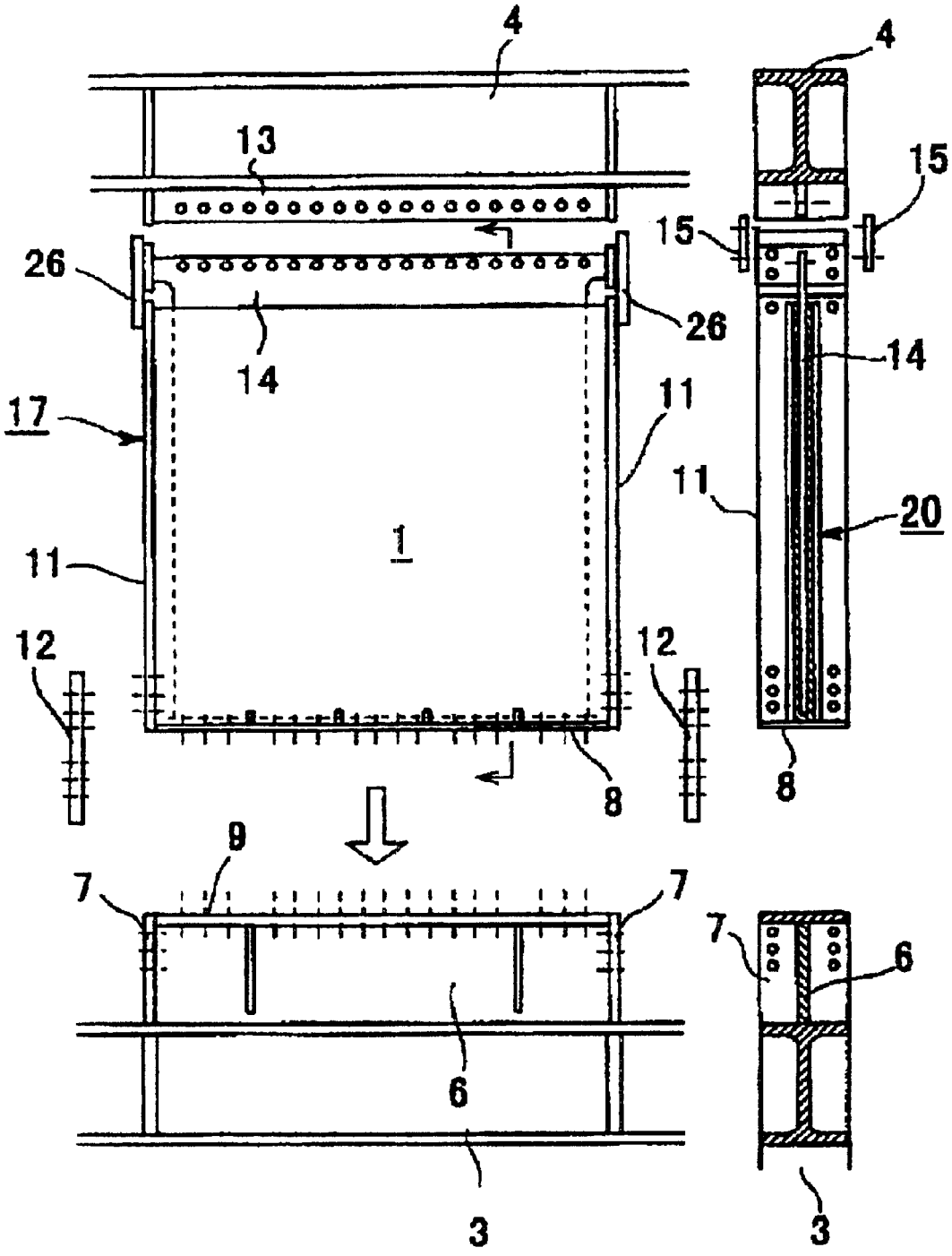
FIG. 5 is an exploded view of installation of the viscous vibration-damping wall in accordance with the invention.

FIG. 5 is an exploded view for explaining a method of installing a viscous vibration-damping wall in accordance with the invention.

The installing operation begins with the fixation to unillustrated pillars of the lower-floor girder 3 with the rising metal plate 6 integrated thereto by welding.

Meanwhile, the housing 20 of the viscous vibration-damping wall 1 is fixed to the upper-floor girder 4 by means of a pair of temporary suspending pieces 26. At the same time, the gusset plate 13 and the intermediate plate 14 are subjected to two-plane friction-type connection by the high-strength bolts by using the pair of splicing plates 15 so as to be directly connected to each other.

It should be noted that the direct connection based on the one-plane friction-type high-strength connection without using the splicing plates is the same as described before.

The upper-floor girder 4 integrated with the viscous vibration-damping wall 1 is suspended and set at a predetermined position, and the use of the temporary suspending pieces 26 makes it possible to prevent the viscous material from undergoing shear deformation by the weight of the viscous vibration-damping wall, fix the viscous vibration-damping wall immovably, and suppress its rotation about the axis of the girder during hanging.

Hanging is carried out to mount the viscous vibration-damping wall 1 on the rising metal plate 6. In a case where the seating of the viscous vibration-damping wall 1 is incomplete, a gap adjusting member such as a filler plate or the like is used so as to allow the viscous vibration-damping wall 1 to be placed on the rising metal plate 6 accurately and stably.

Upon completion of positioning, one-plane friction-type connection using the high-strength bolts 10 is effected between the base plate 8 and the base-plate connecting hole portions 9 and between the flange plate 11 and the flange-connecting gusset plate 7, thereby completing the installation of the viscous vibration-damping wall 1 on the main frame structure.

At this stage, the aforementioned temporary suspending pieces 26 are removed, which makes it possible for the viscous vibration-damping wall 1 to assume a movable state whereby it is capable of demonstrating its intrinsic vibration-damping function, and the installation work is thereby completed.

Figure 6:
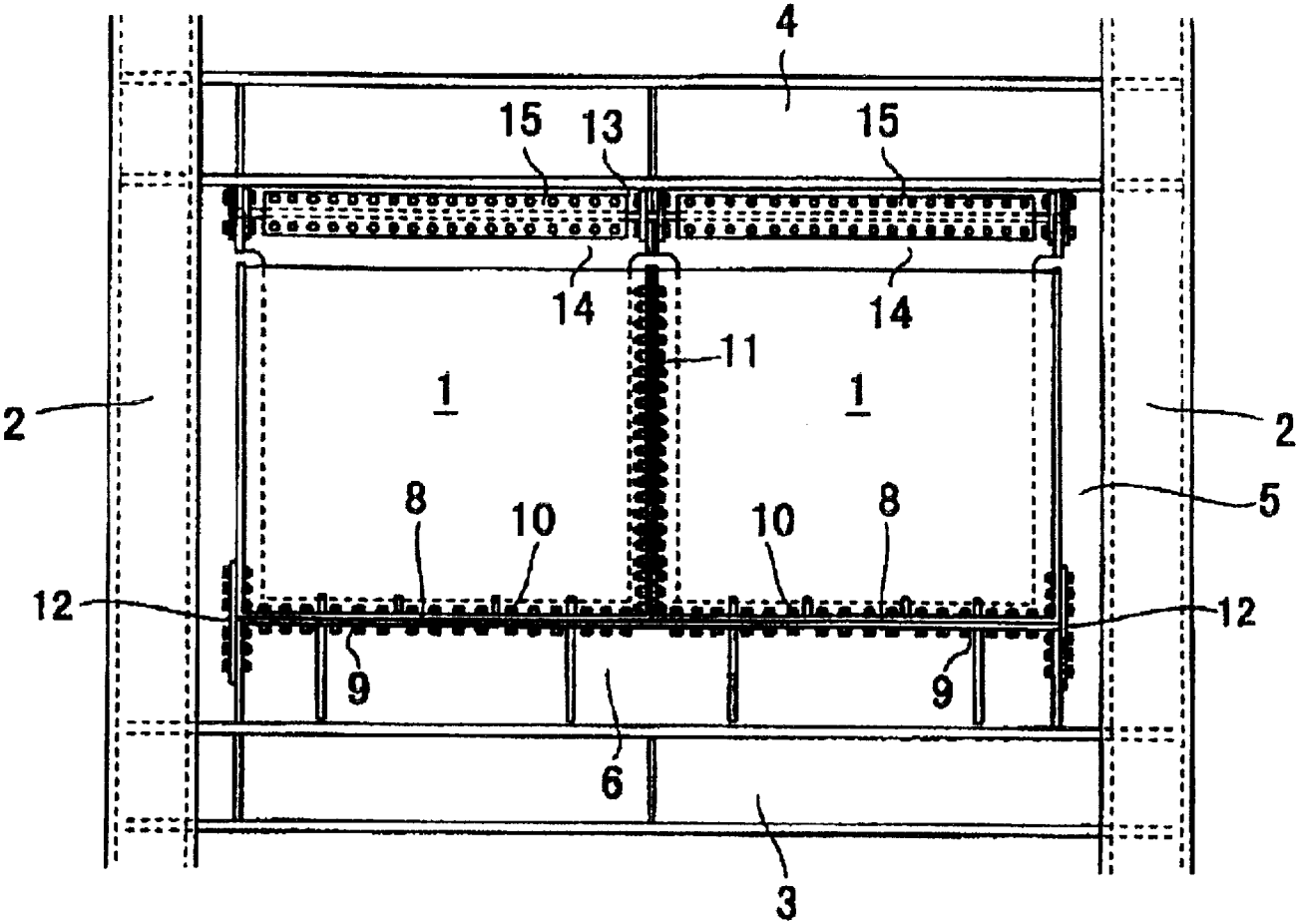
FIG. 6 is a diagram of a state of installation in which a plurality of viscous vibration-damping walls are installed in a juxtaposed manner on the main frame structure in accordance with the invention.

FIG. 6 is an elevational view of a state in which the viscous vibration-damping walls in accordance with the invention are installed in a juxtaposed manner.

A pair of viscous vibration-damping walls 1 are installed in a juxtaposed manner in the plane of structure 5 which is formed by the pair of pillars 2, the lower-floor girder 3, and the upper-floor girder 4, and is joined integrally to the lower-floor girder 3 and the upper-floor girder 4.

The rising metal plate 6 welded to the flange surface of the lower-floor girder 3 has a length allowing two viscous vibration-damping walls 1 to be placed thereon, and is integrated with the lower-floor girder 3, the pair of flange-connecting gusset plates 7 being respectively attached to both sides of the rising metal plate 6 in the same way as the embodiment shown in FIG. 1.

The viscous vibration-damping walls 1 at their mutually opposing flange plates 11 on their one sides are frictionally connected in one plane by the high-strength bolts 10, and this assembly in the integrated state is placed on the rising metal plate 6.

The viscous vibration-damping walls 1 are integrally connected to the lower-floor girder 3 as each base plate 8 and the base-plate connecting hole portions 9 of the rising metal plate 6 are frictionally connected in one plane by the high-strength bolts 10, and the flange plate 11 located on each side of the assembly of the viscous vibration-damping walls and each flange-connecting gusset plate 7 are frictionally connected in one plane by the high-strength bolts 10 by means of the flange connecting plate 12.

The flange-connecting gusset plates 7 process the lifting force of the base plates and the vertical force occurring in edge portions of the viscous vibration-damping walls by receiving as the shearing force of the high-strength bolts the bending moment due to the shearing force which is borne by the integrally connected viscous vibration-damping walls 1 during an earthquake.

Two gusset plates are attached to the lower flange surface of the upper-floor girder 4 in alignment with the web of the girder in the same way as the above-described embodiment.

The intermediate plate of each viscous vibration-damping wall 1 and the gusset plate are clamped by the two splicing plates 15, and are frictionally connected to each other in two planes by the high-strength bolts 10, thereby allowing the viscous vibration-damping walls 1 and the upper-floor girder 4 to be integrally connected.

Figure 7:
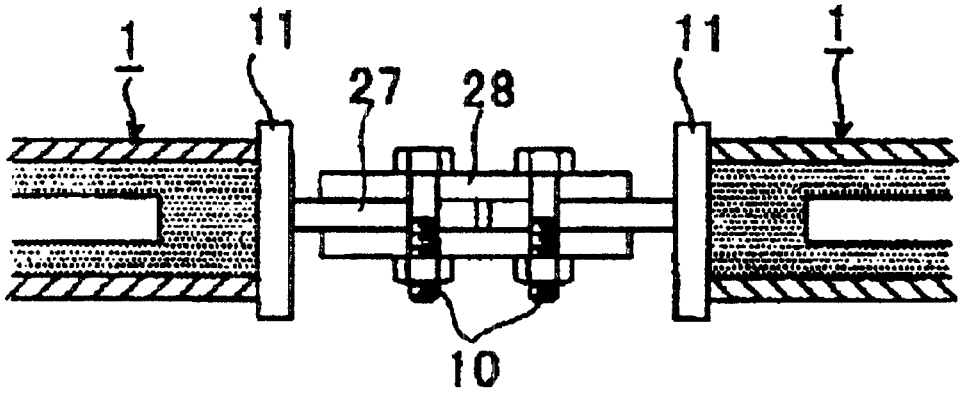
FIG. 7 is a diagram of another state of installation in which plurality of viscous vibration-damping walls are joined.
Figure 8:
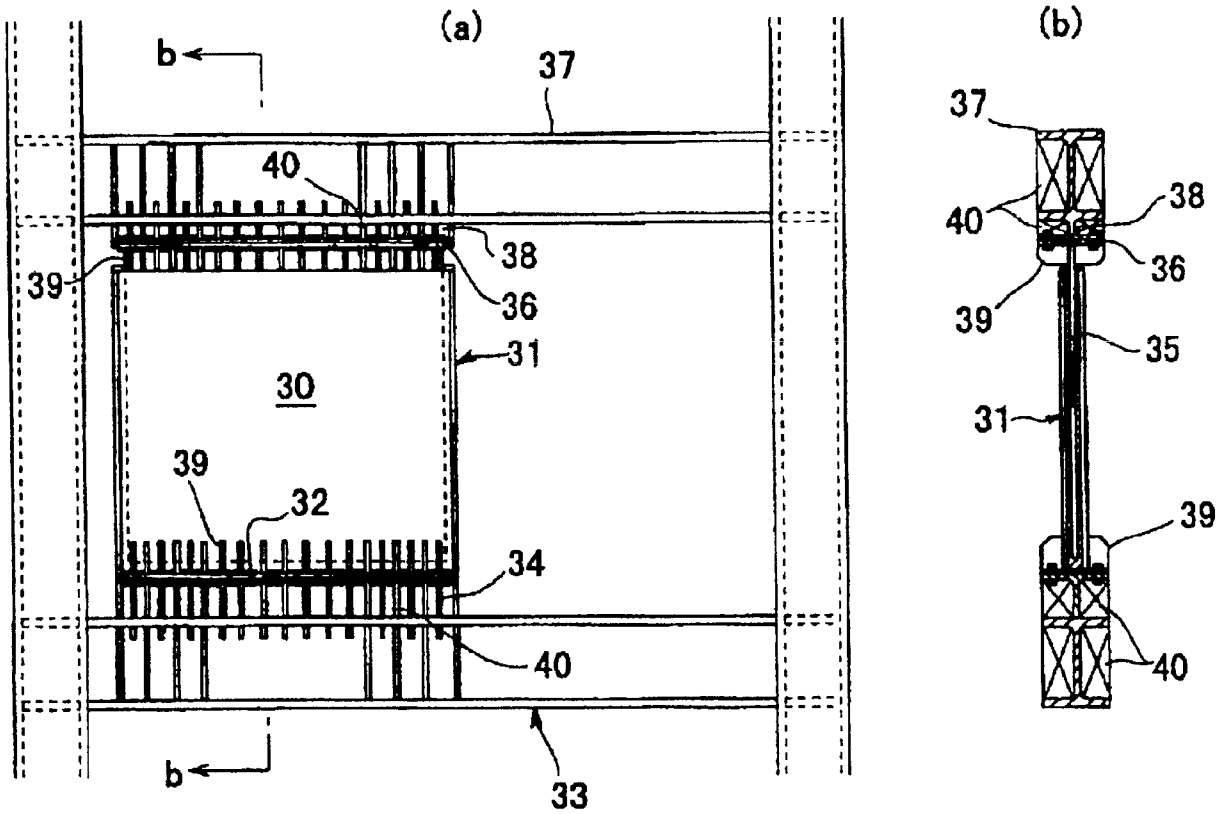
FIG. 8 is a diagram of a state of the conventional installation of a viscous vibration-damping wall.
Figure 9:
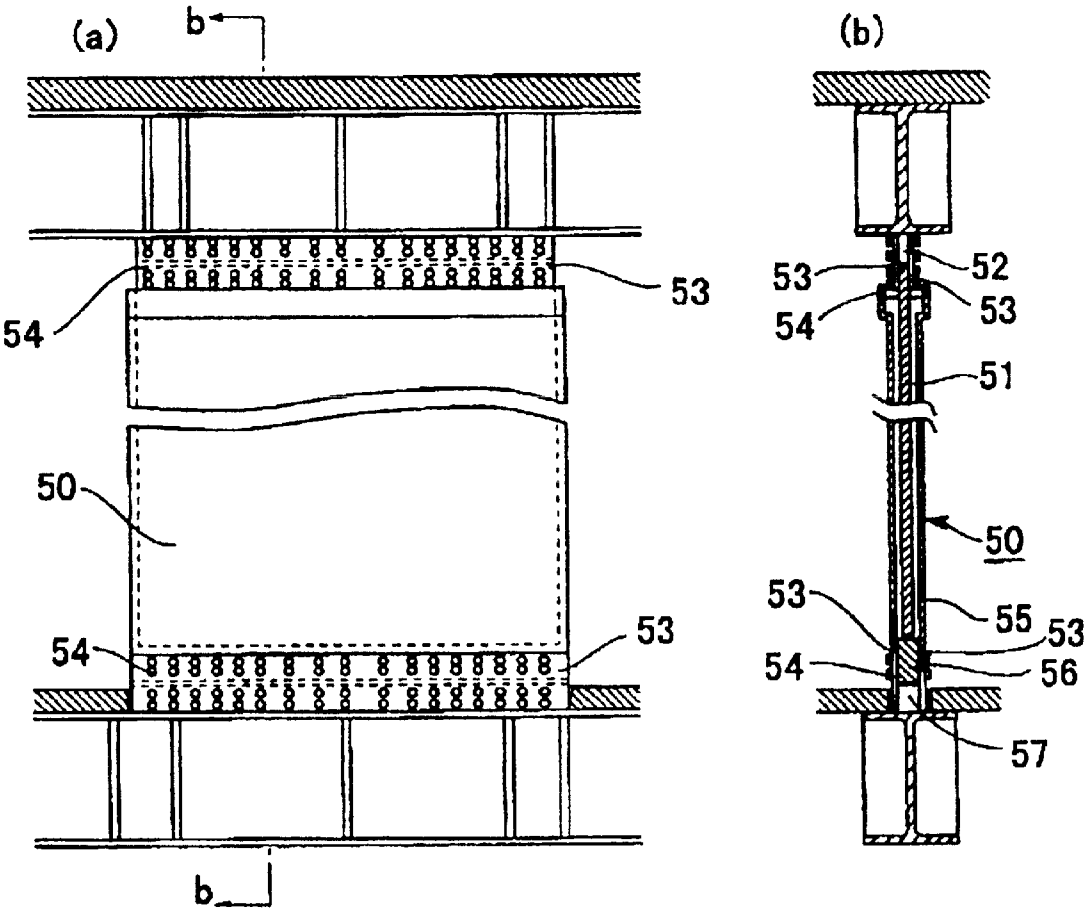
FIG. 9 is a diagram of another state of the conventional installation of a viscous vibration-damping wall.

FIG. 7 shows still another embodiment in which a plurality of viscous vibration-damping walls are joined to each other.

On each opposing flange plate 11 of the viscous vibration-damping wall 1, a gusset plate 27 is disposed in parallel with the upper- and lower-floor girders, and is provided with high-strength bolt holes.

When the two viscous vibration-damping walls 1 are integrated, as shown in the drawing, the two gusset plates 27 are brought close to each other and are clamped by two splicing plates 28, and are frictionally connected to each other in two planes by the high-strength bolts 10, thereby integrally connecting the juxtaposed viscous vibration-damping walls.

In the case of this embodiment, instead of structuring the rising metal plate 6 of a one-piece steel product as in the case of the above-described example explained with reference to FIG. 6, the rising metal plate 6 may be constructed in a mutually divided state in correspondence with the individual viscous vibration-damping walls 1. Thus, as for the shape of the rising metal plate 6, it is possible to select from among various forms, as required.

In the case of this embodiment, since the operator is able to perform the connecting operation with a posture oriented perpendicular to the viscous vibration-damping wall, there is a degree of freedom in the operator's movement as compared with the case where the flange plates 11 are directly joined, so that there is an advantage in that the installation work can be performed simply with a comfortable posture.

As described above, the structure for installing a viscous vibration-damping wall in accordance with the invention is not limited to the installation of a single viscous vibration-damping wall, and is also applicable to the case where a plurality of viscous vibration-damping walls are installed in a juxtaposed manner. Regardless of the number of the viscous vibration-damping walls to be juxtaposed, by subjecting the flange plates on their mutually opposing sides to one-plane friction-type high-strength bolted connection, the entire unit can be handled as one viscous vibration-damping wall. In the fixation of the viscous vibration-damping walls to the upper-floor girder, the integration with the upper-floor girder can be ensured by merely attaching the temporary suspending pieces to the outer flange plates.

What is claimed is:

1. A structure for installing a viscous vibration-damping wall in which a housing with its upper end open is formed by uprightly setting a pair of steel side plates on a base plate and by disposing a pair of flange plates on both sides of said pair of side plates, an intermediate plate is inserted in said housing, and a viscous material or a viscoelastic material is placed in a gap portion between said side plates and said intermediate plate, said structure comprising:

a rising metal plate fixed on a flange of a lower-floor girder and having base-plate connecting hole portions in an upper surface thereof, said base plate being connected to said upper surface of said rising metal plate via said base plate connecting hole portions, each of said flange plates being connected to a first flange-connecting gusset plate fixed to each lateral side end surface of said rising metal plate, and said intermediate plate being directly connected to a second gusset plate attached to a flange of an upper floor girder.

2. The structure for installing a viscous vibration-damping wall according to claim 1, wherein the connection between said flange plate and said flange-connecting gusset plate is one-plane friction-type high-strength bolted connection by means of a flange-connecting gusset plate.

3. The structure for installing a viscous vibration-damping wall according to claim 1, wherein the direct connection between said intermediate plate and said second gusset plate suspended from the flange of said upper-floor girder is one-plane friction-type high-strength bolted connection.

4. The structure for installing a viscous vibration-damping wall according to claim 1, wherein the direct connection between said intermediate plate and said gusset plate is two-plane friction-type high-strength bolted connection using a pair of splicing plates.

5. The structure for installing a viscous vibration-damping wall according to claim 4, wherein each of said splicing plates is divided into a central portion and a pair of side portions.

6. The structure for installing a viscous vibration-damping wall according to claim 2, wherein the direct connection between said intermediate plate and said second gusset plate suspended from the flange of said upper-floor girder is one-plane friction-type high-strength bolted connection.

7. The structure for installing a viscous vibration-damping wall according to claim 2 wherein the direct connection between said intermediate plate and said gusset plate is two-plane friction-type high-strength bolted connection using a pair of splicing plates.

8. A method of installing a viscous vibration-damping wall including a housing with an upper end portion formed by uprightly setting a pair of steel side plates on a base plate, a pair of flange plates on both sides of said pair of side plates, an intermediate plate in said housing and a viscous material or a viscoelastic material placed in gaps between said side plates and said intermediate plate, on a structure wherein the structure includes a rising metal plate fixed on a flange of a lower plate girder and having base plate connecting hole portions in an upper surface thereof, said base plate being connected to said upper surface of said rising metal plate via said base plate connecting hole portions, each of said flange plates being connected to a first flange connecting gusset plate fixed to each lateral side end surface of said rising metal plate, and said intermediate plate being directly connected to a second gusset plate attached to a flange of an upper floor girder, comprising the steps of:

setting said rising metal plate and said flange connecting gusset plate on said lower floor girder;

setting at a predetermined position said upper floor girder and said viscous vibration-damping wall by connecting said intermediate plate to said further gusset plate suspended from the flange of the upper floor girder and by connecting said housing to said upper floor girder by means of a pair of temporary suspending pieces;

subjecting said base plate and said flange plates to friction-type high-strength bolted connections to said base plate connecting hole portions and said first flange connecting gusset plates, respectively; and removing said temporary suspending pieces.

* * * * *